US008056626B2

(12) United States Patent
Murphy et al.

(10) Patent No.: US 8,056,626 B2
(45) Date of Patent: Nov. 15, 2011

(54) WELLBORE FLUID REDISTRIBUTION AND FLUID DISPOSAL IN WELLBORE ENVIRONMENTS

(75) Inventors: Raymond P. Murphy, Litchfield Park, AZ (US); Timothy G. Barritt, Upton, WY (US); Richard G. Stockdale, Cheyenne, WY (US)

(73) Assignee: Big Cat Energy Corporation, Gilette, WY (US)

( * ) Notice: Subject to any disclaimer, the term of this patent is extended or adjusted under 35 U.S.C. 154(b) by 533 days.

(21) Appl. No.: 12/291,664

(22) Filed: Nov. 10, 2008

(65) Prior Publication Data

US 2009/0090510 A1 Apr. 9, 2009

Related U.S. Application Data

(63) Continuation-in-part of application No. 11/399,793, filed on Apr. 5, 2006, now abandoned.

(60) Provisional application No. 60/668,896, filed on Apr. 5, 2005.

(51) Int. Cl.
*E21B 43/14* (2006.01)

(52) U.S. Cl. ..... 166/266; 166/106; 166/369

(58) Field of Classification Search ..... 166/380, 166/54.1, 105, 126, 129, 133, 142, 146, 149, 166/180, 183, 184, 185, 186, 188, 189
See application file for complete search history.

(56) References Cited

U.S. PATENT DOCUMENTS

| | | | | |
|---|---|---|---|---|
| 3,170,520 | A * | 2/1965 | Arutunoff | 166/65.1 |
| 5,913,363 | A | 6/1999 | Paplinski | |
| 5,979,559 | A * | 11/1999 | Kennedy | 166/369 |
| 6,123,149 | A | 9/2000 | McKinzie et al. | |
| 6,325,143 | B1 * | 12/2001 | Scarsdale | 166/54.1 |
| 7,216,720 | B2 * | 5/2007 | Zimmerman | 166/387 |
| 7,487,838 | B2 * | 2/2009 | Knight et al. | 166/369 |

OTHER PUBLICATIONS

U.S. Appl. No. 60/668,896, filed Apr. 5, 2005.
U.S. Appl. No. 11/399,793, filed Apr. 5, 2006.
Patent Cooperation Treaty patent application No. PCT/US2006/012789, filed Apr. 5, 2006.

* cited by examiner

*Primary Examiner* — Daniel P Stephenson
(74) *Attorney, Agent, or Firm* — Craig R. Miles; CR Miles, P.C.

(57) ABSTRACT

Generally, devices and methods of redistribution of fluids produced in well bore environments. Specifically, well bore fluid redistribution apparatuses which can isolate and redistribute fluids produced in well bores between geologic sections to reduce surface discharge of fluids.

22 Claims, 10 Drawing Sheets

WELLBORE FLUID REDISTRIBUTION AND FLUID DISPOSAL IN WELLBORE ENVIRONMENTS

This United States patent application is a continuation-in-part of U.S. patent application Ser. No. 11/399,793, filed Apr. 5, 2006, which claims the benefit of U.S. Provisional Patent Application No. 60/668,896, filed Apr. 5, 2005, each hereby incorporated by reference herein.

I. TECHNICAL FIELD

Generally, devices and methods of redistribution of fluids produced in well bore environments. Specifically, well bore fluid redistribution apparatuses which can isolate and redistribute fluids produced in well bores between geologic sections to reduce surface discharge of fluids.

II. BACKGROUND

Methane gas may be produced in the mining of coal. Coal formations naturally produce methane gas. For example, methane gas may be produced by dewatering activities of the mining process. Methane gas that is contained in the coal formation may be biogenic (generated by biologic organisms) or organic (generated by organic decomposition of coal) origin.

Recovery of the methane gas present in coal formations is a major source of methane gas for the modern coal bed methane (CBM) industry. The recovery of such methane gas from coal formations frequently involves the removal of water from the coal bed, so as, for example, to provide a reduction of pressure within the formation. The water may often be found within the coals and typically may be under pressure that increases with depth below the surface. Methane gas can be contained in the formation, for example in solution with the formation water (either free flowing or interstitially within the rock) or adsorbing to the surface of the rock. In mining operations, it may be necessary to remove the water prior to collecting the ore. The removal of water may liberate the methane from the water or the formation by reducing the pressure under which the water is found.

In well operations, it may be necessary to pump water from the coal aquifer when the well is completed for a coal bed methane well to produce gas. Although other factors, including formation characteristics, well drilling methods, and pumping rates may play a role in production, it may be that the removal of water is possibly the most important well production factor. Traditional techniques to remove water from the well bore may include the use of a submersible pump. The pump may be placed at a depth to maximize gas flow.

The process of obtaining the maximum gas flow is often referred to as well optimization and may involve many factors. Well optimization may occur when the intake of the pump is set at a depth in the well to allow the maximum gas to be produced. If the intake is set too high in the well, water from the formation may not be sufficiently produced. In some instances, the weight of the water with reference to static water level (SWL) may prohibit the gas from desorbing from the coal and water. If the intake is set too low, water from the formation may not be sufficiently produced and the water may no longer float the coal fractures (keeping them open), possibly negatively affecting gas desorption or possibly inhibiting the flow of gas out of the coal seam. The pumping rate of the water may be used to fine tune the static water level in the well bore and may be tied to many geologic factors. Water production rates may vary from 1 gallon per minute to several hundred gallons per minute, again depending possibly on geologic conditions such as coal permeability and the thickness of the coal itself Produced water of coal bed methane production may be discharged to the land's surface, possibly along ephemeral drainages, tributaries and reservoirs. The quality of the produced water may vary from better than some bottled waters to poor, possibly depending on proximity of the coal bed methane well to the coal aquifer recharge area. Water qualities of coal bed methane wells in some regions typically may be better than the shallow aquifer systems that may often be used by agricultural concerns for purposes such as stock watering. However, water quality problems may occur after the water reaches the surface and travels for any distance. Surface soils may often contain salts (cations and anions) which the water may possibly dissolve as it moves along through these surface soils. At some point in the drainage, these salts may begin to accumulate, thus possibly reducing the discharged water quality. This issue may heretofore have been the subject of many studies exploring how this process may occur and the amount of time and distance over which this effect may become apparent.

The discharged water may become impaired because the discharged water may acquire salts along its path to tributaries. This impaired water may ultimately comingle with unimpaired water and may eventually degrade the fresh water supply. In an effort to monitor the amount of impaired water entering the fresh water system, governmental agencies have developed regulatory rules such as requirements for coal bed methane producers, for example permit requirements. One such permit requirement involves acquiring a National Pollution Discharge Elimination System (NPDES) permit. However, the NPDES permit acquisition process may involve significant drawbacks for coal bed methane producers, including the possibility of a substantial time and financial investment for the producer in obtaining the permit and the possibility of a denial of the permit.

In addition, environmental interests have expressed the concern that coal bed methane industry practices waste limited fresh groundwater resources. It is typically suggested that water produced by coal bed methane processes should be re-injected back into the ground. However, traditional re-injection methods may not have been economically viable to re-inject a high volume of produced water from a large number of wells. The drilling costs of each well may detract from economic viability of traditional re-injection methods. Furthermore, some formations may already contain a substantial amount of water, thus requiring large pump pressures to exceed the fracture rate of these formations in order to inject the additional waters. Traditional re-injection methods, furthermore, may be cost prohibitive given surface equipment and processes required.

Attempts may have been made to re-inject produced water into a principal drinking water aquifer where aquifer capacity may be available from a number of supply wells. However, facility and treatment costs may be prohibitively expensive. Other traditional re-injection techniques involve drilling an additional well or wells near an existing coal bed methane well for re-injection into a shallow aquifer system, but again these attempts may not have been economically viable due to the added costs of the additional wells as well as equipment and pumping costs to reinject the water back into the formations. Yet other attempts have involved using the produced water for irrigation, but the expenses involved in irrigation (for example, the capital outlay for an irrigation system and the treatment of soils to prevent souring) may have been so high as to be economically unsustainable. Still attempts may have involved the use of large leach-fields to dispose of water, but it may have been that relatively low permeability soils such as tight clay soils hindered the percolation process.

Other water removal attempts have been made in the context of brine water produced from conventional oil and gas reservoirs. For example, U.S. Pat. No. 3,363,692 discloses the use of a conventional beam pump or possibly pressure from the formation itself to move brine water mechanically into a shallower brine formation. However, this technique may be dependent on certain pressure ranges to work properly and may perhaps require a time cycle controller to switch a valve when water reaches a set height or time. Another patent, U.S. Pat. No. 5,816,326, discloses the use of a conventional beam pump to move brine water mechanically into a brine formation. This technique, however, appears to require the use of two mandrels to isolate perforations adjacent to a porous formation and perforated tubing to allow brine water to exit the tubing string.

The technologies of the above referenced patents and other similar technologies may also be limited in application to brine water disposal for oil and gas reservoirs and not particularly addressing the complexities of redistribution of fresh water into a fresh water system or the corresponding environment. Furthermore, the complexities associated generally with oil and gas reservoirs and traditional production equipment may actually lead those in the field away from thoughts of more efficient and less mechanically complex techniques, and particularly given the differences in the production environment.

It may be that previous attempts have been made to avoid the possible need of obtaining an NPDES permit for discharging water to the ground surface. It may also be that use of re-injection, irrigation and percolation may allow for different permitting requirements less stringent than, for example, the NPDES permit. Accordingly, a need may exist to avoid the NPDES permit system altogether, thus possibly streamlining the permit procedure and potentially reducing costs.

Water may also have a role in the secondary and tertiary recovery of oil and gas. Secondary and tertiary recovery is the recovery of oil or gas, or combinations thereof, in production-depleted reservoirs exhibiting low pressure or low flow rates, such that production is not economical or too much gas or water is present. The formation pressure, volume of product, product displacement, or fluid flow may be reduced for various reasons. In some optimal oil fields, it may sometimes be estimated that approximately 30 percent of the oil may be removed by pumping the wells (primary recovery), thus leaving perhaps 70 percent of the oil as unrecoverable. Secondary recovery, including traditional lift systems and injection methods, is typically implemented to maintain pressure and sustain production at viable rates.

Tertiary recovery or enhanced recovery alters the original oil properties and further maintains formation pressure and may be able to increase production by perhaps about 15% percent. Tertiary recovery may comprise techniques such as chemical or water flooding, miscible displacement, and thermal recovery. Examples include forms such as water flood, nitrogen flood, fire flood and steam flood. Each such technique may be reservoir dependent, and often the choice of technique may be based upon economics and availability. For example, if there is no readily available source of $CO_2$ near the production facility (miscible displacement), it may be that a $CO_2$ flood may not be economically viable.

Water injection and water flooding may be common forms of secondary and tertiary recovery, perhaps due to the typical availability of large quantities of water during production. Water may be acquired perhaps by drilling a water supply well or possibly by using by-product water from existing operations. This water may typically need to be treated, perhaps by chlorination, to some standard prior to being re-injected. Injection wells may often be other existing wells, perhaps which may have diminishing production or possibly which may be optimally located for the flooding operation. However, sometimes new wells may be drilled in an area to serve solely as injection wells.

The principal in traditional water flooding may be to move the oil or other recoverable substance that may be contained within a reservoir formation to the pumping bore of a production well and to maintain formation pressure. To accomplish this technique, water may be pumped into the reservoir formation, perhaps so as to displace the trapped oil or other recoverable substance and possibly to move it towards a production well. The amount of pressure involved in driving the water within the reservoir formation may be highly variable. Such pressure may rely primarily on the transmissivity of the reservoir formation. Such pressure also may be influenced by the casing size of the well bore and the number and type of perforations made in the casing. Water flooding may typically require surface facilities such as one or more storage tanks (tank batteries), treatment facilities, pumping equipment and pipelines to be constructed. Such surface facilities may ultimately increase the operating cost of the field, perhaps reducing the economic viability of the operation.

The foregoing problems regarding conventional techniques represent a long-felt need for an effective solution. Actual attempts to meet the need to dispose or treat produced water may have been lacking in one or more aspects, for example as previously described. Those skilled in the art may not have fully appreciated the nature of the problems and challenges involved. As a result, attempts to meet these needs may not have effectively solved one or more of the problems or challenges here identified. These attempts may even have taught practices diverging from the technical directions taken in the present invention. The present invention could be considered an unexpected result of new approaches to conventional techniques that have been taken by some in the field.

III. SUMMARY OF THE INVENTION

The redistribution of fluids in well bore environments is disclosed herein in accordance with the present invention. In some embodiments, the invention is the redistribution of fluid within a well bore. The fluid may be water produced in a coal bed methane well. The redistribution of fluid, such as water, from one geologic section such as a formation to another is disclosed herein, and the redistribution from one aquifer to another aquifer is provided in accordance with the present invention. The redistribution of fluid from multiple geologic sections such as one or more formations to other geologic sections such as another formation is also disclosed. Furthermore, the injection of a geologic section with fluid, such as water produced in a coal bed methane well, and in some embodiments as a water flood of a geologic section such as a reservoir formation, in accordance with the present invention is disclosed. Some embodiments are directed to injecting fluid into at least one geologic section above a depth, while some embodiments are directed to injecting fluid into at least one geologic section below a depth. Some embodiments are directed to the redistribution of fluid from multiple producing geologic sections. Still further embodiments provide commingling of produced gases from multiple sections as a further embodiment of the present invention. Each of the embodiments of the present invention is disclosed both as methods and processes as well as one or more apparatus and assembly.

The present invention in some embodiments is disclosed as one or more well bore fluid redistribution assembly or well bore fluid redistribution apparatus. The invention in some embodiments is methods of complying with water discharge rules. Other embodiments are water disposal, aquifer recharge, transfer of water from one aquifer or multiple aquifers to another, and obtaining a permit. Still other embodiments of the present invention are the provision of re-dressable packer assembly. Other embodiments are directed to fully connectable ports providing for features of the present invention.

One object of the present invention may be to address and perhaps avoid discharging water produced by coal bed methane wells to the surface. Still another object of the invention may be to address compliance with water discharge rules. Another object of the invention may be to address and minimize regulatory costs associated with redistributing water produced by coal bed methane wells. Yet a further object of the invention may be to redistribute water from one geologic section to another, or from multiple geologic sections to another, such as from one aquifer or a plurality of aquifers to another aquifer. An additional object of the invention may be to provide a water flood of a geologic section, such as a formation reservoir. Another object of the invention may be to provide for multiple completion sections of a well and to facilitate circulation of a fluid such as water to maintain well conditions as part of the present invention. Still other objects may be to provide for the exchange of seal elements and for the ports of the present invention to allow for the connection with other features of the present invention.

Naturally, further objects of the invention will become apparent from the description and drawings below.

IV. A BRIEF DESCRIPTION OF THE DRAWINGS

V. DETAILED DESCRIPTION OF THE PREFERRED EMBODIMENTS

Generally, devices and methods of redistribution of fluids produced in well bore environments. Specifically, well bore fluid redistribution apparatuses which can isolate and redistribute fluids produced in well bores between geologic sections to reduce surface discharge of certain portions of the fluids.

Figure 1:
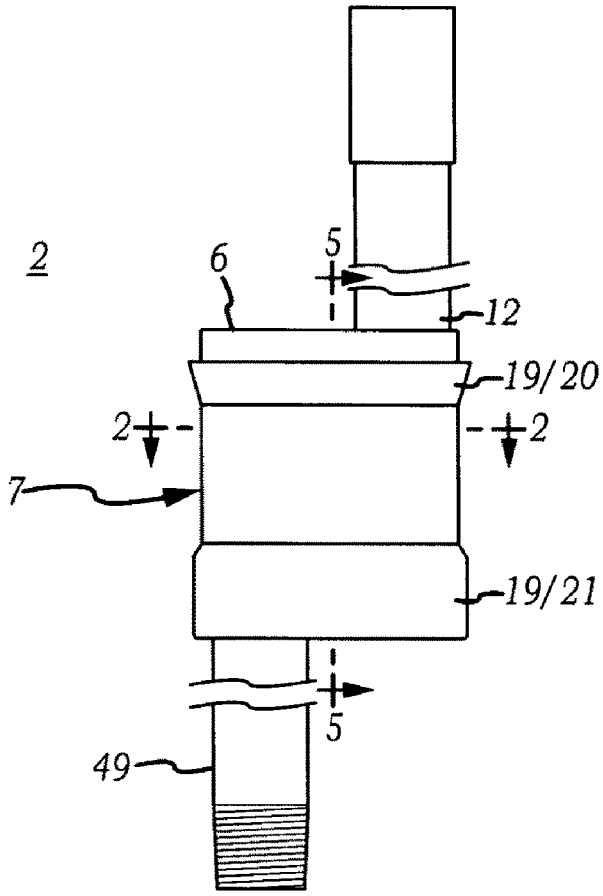
FIG. 1 is a front view of a particular embodiment of a well bore fluid redistribution apparatus.
Figure 2:
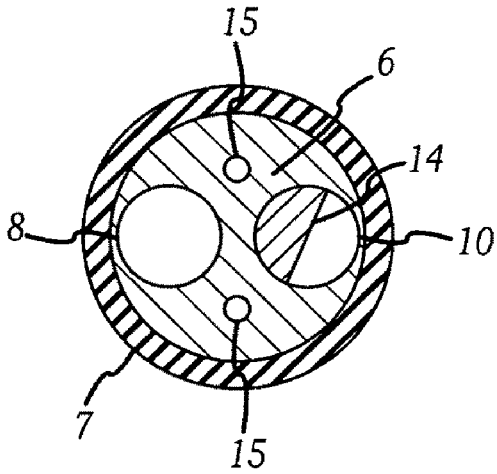
FIG. 2 is a cross-section view of the particular embodiment of the well bore fluid redistribution apparatus.
Figure 3:
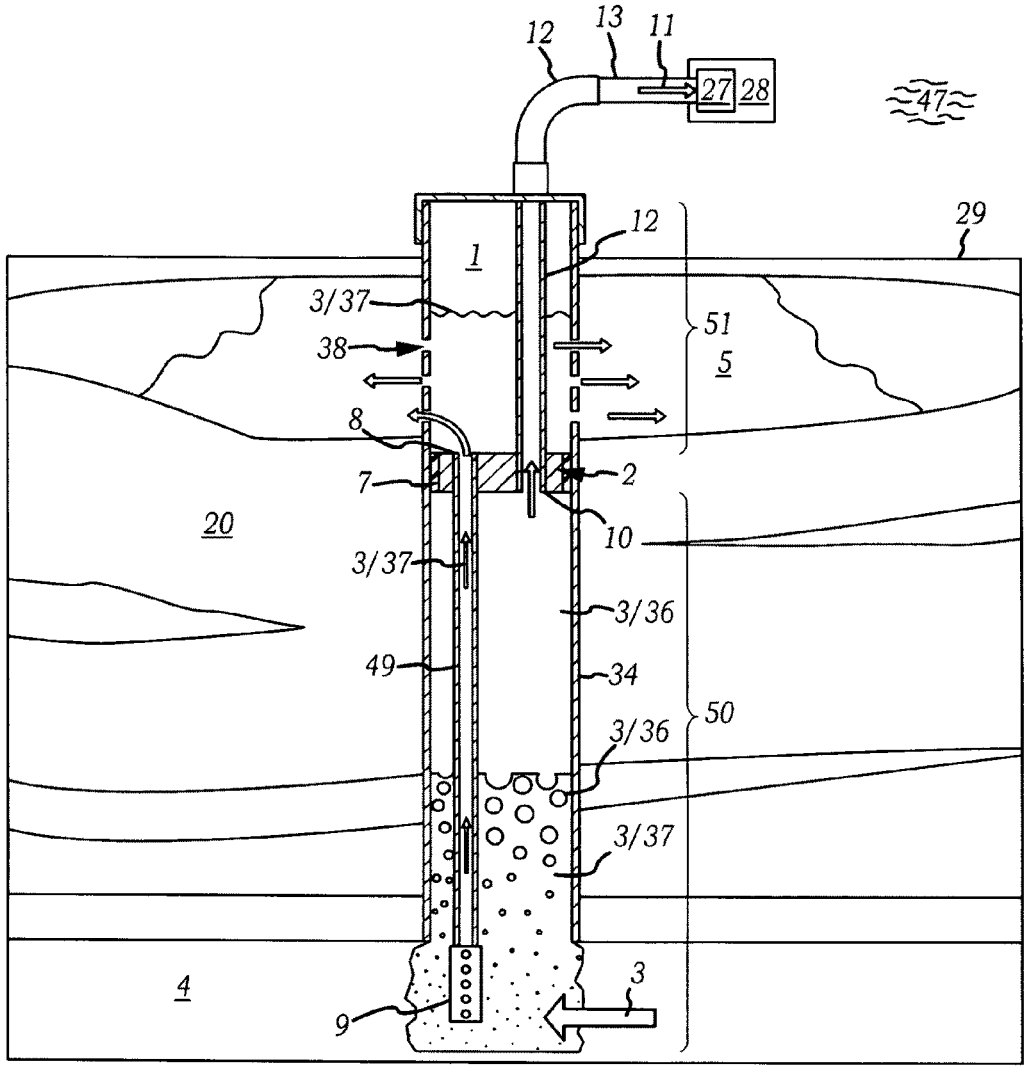
FIG. 3 is a cross-section view a particular embodiment of a well bore fluid redistribution apparatus having a location in a well bore.

Now referring primarily to FIGS. 1, 2 and 3, certain embodiments of a well bore fluid redistribution apparatus (2) (also referred to as the "apparatus") are shown which can be located in a well bore (1) (see example in FIG. 3). The external surface of the well bore fluid redistribution apparatus (2) can sufficiently circumferentially engage a corresponding part of the well bore (1) (or the well bore casing (34)) to isolate fluid (3) on either side of the apparatus (2). The fluid (3) isolated on either side of the apparatus (2) can be redistributed within the well bore (2) or redistributed between a first geologic section (4) and a second geologic section (5) (or more geologic sections depending upon the application) in communication with the well bore (1) by operation of the apparatus (2), as further described below.

Now referring primarily to FIGS. 1 and 2, certain embodiments of the well bore fluid redistribution apparatus (2) can provide a body (6) configured to coaxially slide in the well bore (1) having an external surface configured to engage a corresponding surface of the well bore (1) to isolate the fluid (3) in the well bore to either side, as above described. Other embodiments of the apparatus (2) can further include a well bore seal element (7) which can engage a part of the external surface of the body (6). The well bore seal element (7) can sealably engage a corresponding part of the surface of the well bore (1) (or a part of the surface of a well bore casing (34)) to isolate the fluid (3) on either side of the well bore redistribution apparatus (2). Certain embodiments of the well bore seal element (7) circumferentially engage the body (6) of the well bore redistribution apparatus (2) (see for example the embodiments shown in FIG. 1 and FIG. 2); however, the specific embodiments of the invention shown in FIGS. 1 and 2 are not intended to be limiting and certain embodiments of the invention can provide the body (6) without the well bore seal element (7) or with a well bore seal element (7) which is differently configured but yet capable of sealably engaging a corresponding part of the surface of the well bore (1) (or the well bore casing (34)).

Figure 4:
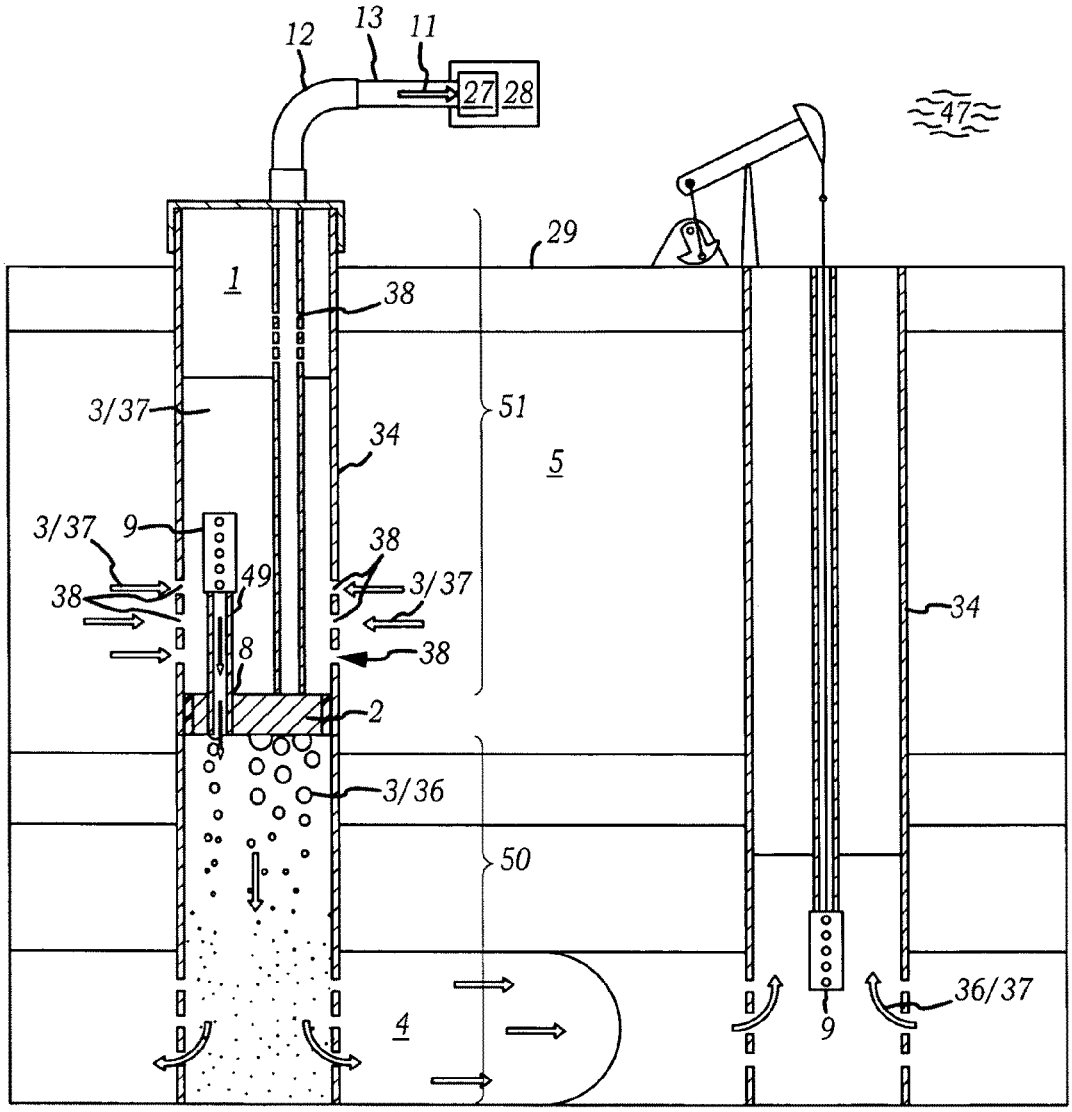
FIG. 4 is a cross-section view of another particular embodiment of a well bore fluid redistribution apparatus having a location in a well bore.

Now referring primarily to FIGS. 2, 3 and 4, a first port (8) (which can be one, two or a plurality of first ports depending upon the embodiment of the invention) can provide fluid communication through the body (6) of the apparatus (2). The first port (8) can be coupled to a pump (9) by a pump conduit (49). The pump conduit (49) can couple to each of the first port (8) and the pump (9) with mated threads, welded joints, compression fittings, or other matable coupling elements. Specifically referring to FIG. 3, as to certain embodiments of the invention, the pump (9) can be located in an amount of the fluid (3) in the form of a liquid (37) isolated below the apparatus (2) (also referred to as the first portion (50) of the well bore (1)). The pump (9) may be a submersible or progressive cavity pump or other manner of device which can generate a flow (shown by arrows in the Figures) of the fluid (3) in the form of a liquid (37). Operation of the pump (9) can transfer of an amount fluid (3) in the form of a liquid (37) isolated below the apparatus (2) from a first geologic section (4) (the term "first geologic section" broadly defines one or more geologic sections) to a second geologic section (5) (the term "second geologic section" broadly defines one or more geologic sections) above the apparatus (2). Now referring specifically to FIG. 4, as certain other embodiments of the apparatus (2), the pump (9) can be located in an amount of fluid (3) (shown as an amount of liquid (37) isolated above the apparatus (2) in the well bore (1) (also referred to as the second portion (51) of the well bore (1)). Operation of the pump (9) can transfer the amount fluid (3) isolated above the apparatus (2) in the well bore (1) from the second geologic section (5) (the term "second geologic section" broadly defines one or more geologic sections) to the first geologic section (4) (the term "first geologic section" broadly defines one or more geologic sections) below the apparatus (2).

Again referring primarily to FIGS. 2, 3 and 4, the apparatus (2) can include a second port (10) (which can be one, two, or a plurality of second ports depending upon the embodiment of the invention). A particular embodiment of the second port (10) provides fluid communication through the body (6) of the apparatus (2) to facilitate transfer of an amount of bypass fluid (11) isolated below the apparatus (2) through the body (6) of the apparatus (2) and through a bypass conduit (12) to a well outlet (13). The bypass fluid (11) can be a gas (36) (such as a mixture of gases, coal bed gases, methane gas, air, or the like, whether alone or in various permutations and combinations). Certain embodiments of the second port (10) can further include a flow control element (14) to control flow of the bypass fluid (11) through second port (10). The flow control element (14) can be one or more valves coupled to the second port (10). Such valves may include check valves, ball or globe valves, gate valves, or similar flow control elements.

Now referring primarily to FIG. 2, the well bore fluid redistribution apparatus (2), can further provide one or more utility ports (15). The utility ports (15) each provide a passage through the body (6) of the apparatus (2) through which power cables, sensors, transducers, or the like, can pass from above the apparatus (2) to below the apparatus (2) in the well bore (1). While the embodiment of the invention shown in FIG. 2 provides two utility ports (14), the invention is not so limited and any number of utility ports can be provided depending on the application one, two, or a plurality.

Figure 5:
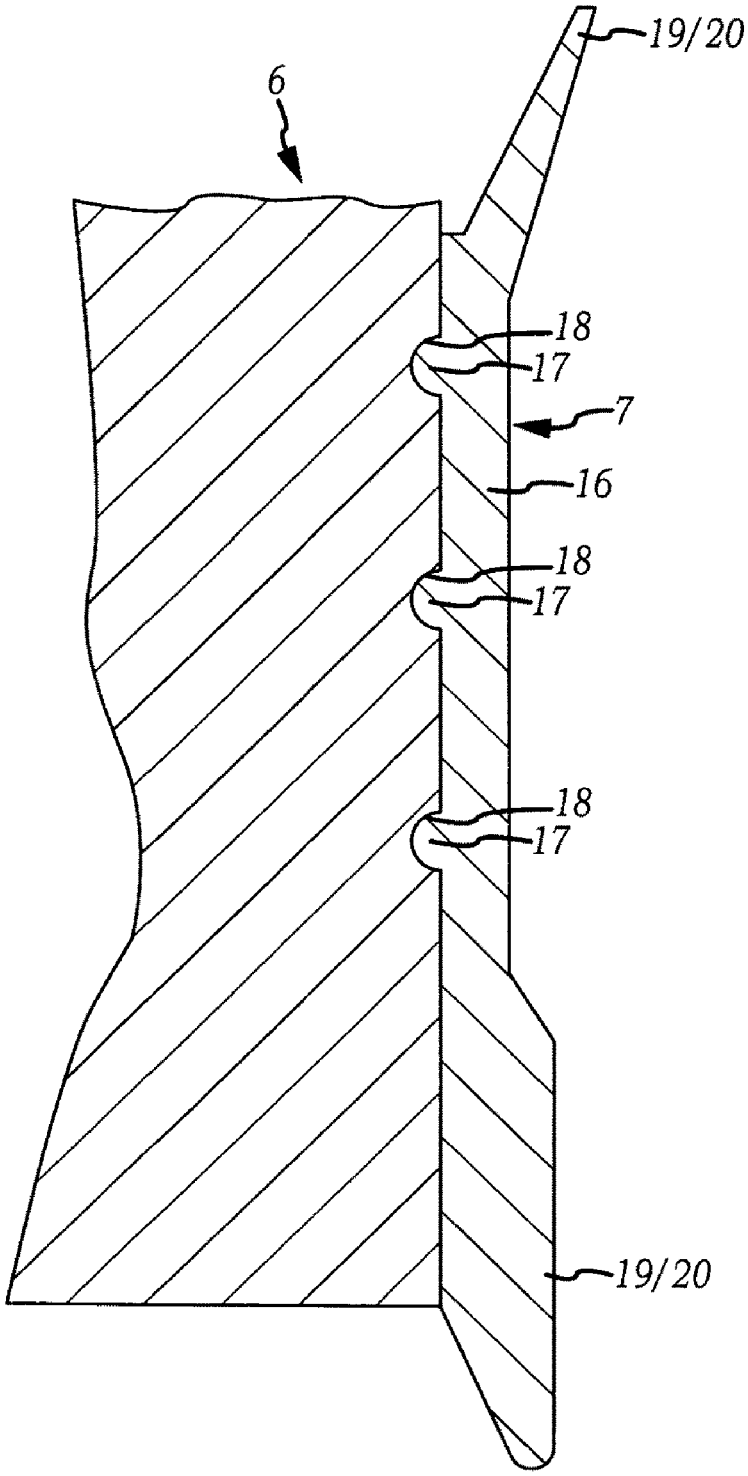
FIG. 5 is cross-section view of a particular embodiment of a well bore seal element.

Now referring primarily to FIG. 5, a particular embodiment of the well bore seal element (7) is shown which has the general structure and relative dimensions shown in the cross-section view. The embodiment of the well bore seal (7) provides a sleeve (16) which circumferentially couples or couples about the body (6) of the apparatus (2) in similar fashion to the embodiment of the well bore seal element (7) shown in FIG. 1. One or more fastening elements (17) can be coupled to the sleeve (16). The fastening elements (17) can be configured to engage the body (6) of the apparatus (2). For example, the embodiment of the fastening elements (17) shown in FIG. 5 engage correspondingly configured circumferential grooves (18) of the body (6) to hold the well bore seal (7) in fixed relation to the body (6) of the apparatus (2) during normal use. While the embodiment of the fastening elements (17) shown in FIG. 5 provides three rings of semicircular configuration each of which can fit a correspondingly configured circumferential semicircular groove (18) of the body (6) of the apparatus (2), the invention is not so limited, and the fastening elements (17) can be of any configuration which sufficiently fixes the sleeve (16) in relation to the body (6) of the apparatus (2) to allow normal use and sealable engagement of the apparatus (2) with a corresponding part of the well bore (1). For example, the fastening elements (17) can be a greater of lesser number of rings or other projection elements, of greater or lesser relative dimension, of similar or different geometric configuration (such as triangular, rectangular or square, or the like) or can be mechanical fasteners such screws or bolts having a spirally threaded shaft which interpenetrates the sleeve (16) to rotatingly couple in correspondingly spirally threaded bore of the body (6) of the apparatus (2).

The well bore seal (7) can further include one or more seal elements (19) coupled to the sleeve (16) which project a sufficient distance outwardly from the body (6) of the apparatus (2) to allow sealable engagement with the corresponding part of the well bore (1). As to certain embodiments of the invention, the seal elements (19) can take the constructional form in cross-section of a substantially triangular element (20) as shown in FIG. 5, or can be a raised portion (21) of the sleeve (16) (that portion of the sleeve (16) having a greater thickness) as shown in FIG. 5; however, the particular configuration of the seal elements (19) shown in FIG. 5 is not intended to be limiting with respect to the numerous and wide variety of seal element (19) configurations which can allow sealable engagement with the corresponding part of a well bore (1).

Figure 6:
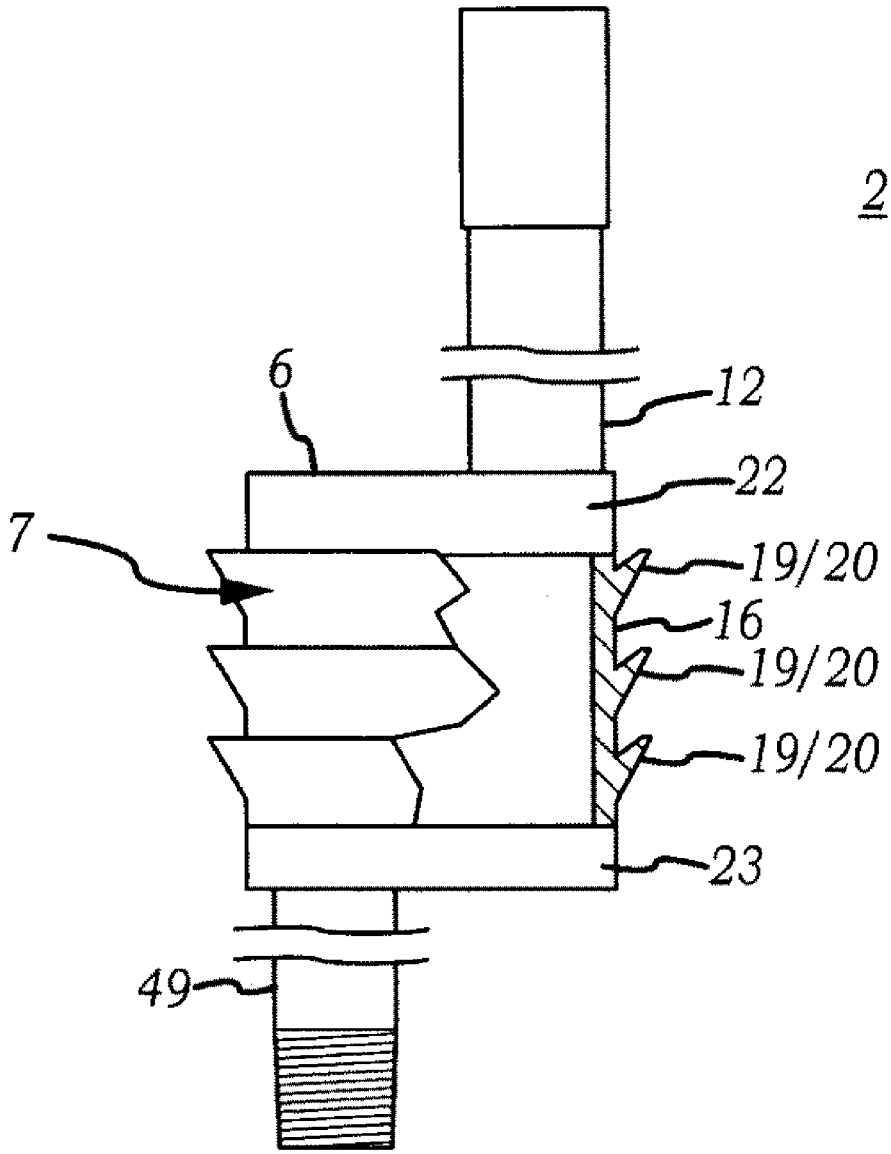
FIG. 6 is a front view of an embodiment of a well bore fluid redistribution apparatus with a particular embodiment of a well bore seal element shown in cross-section.

Now referring primarily to FIG. 6, a further embodiment of a well bore seal element (7) provides a sleeve (16) configured to circumferentially engage the body (6) of the apparatus (2) between a pair of raised bands (22) (23). The pair of raised bands (22) (23) and the body (6) can be produced as a single piece and the sleeve (16) can be produced of sufficiently resiliently flexible material to allow the sleeve (16) in a stretched condition to be drawn over the first of the pair of raised bands (22) and located between the pair of raised bands (22) (23) in the unstretched or retracted condition. Alternately, the pair of raised bands (22) (23) and the body (6) can be produced as a plurality of pieces with the sleeve (16) fitted about the body and the pair of raised bands (22) (23) subsequently coupled to the body (6) of the apparatus (2). Location of the sleeve (16) between the pair of raised bands (22) (23) can provide another embodiment of a fastening element (17) to the examples shown in FIG. 5 and above described or an alternative to providing any other fastening element (17). The raised bands (22) (23) shown in FIG. 6 are not intended to have any particular dimensional relationship to the body (6) or the sleeve (16) other than to provide a recessed part in which the sleeve (16) can be located with the seal elements (19) projecting sufficiently beyond the raised bands (22) (23) to engage a corresponding part of the well bore (1).

In the particular embodiment of the invention shown in FIG. 6, a plurality of seal elements (19) can be circumferentially disposed about the sleeve (16) to project outwardly a sufficient distance to sealably engage with a part of the surface of the well bore (1) (or the well bore casing (34)). While three seal elements (19) are shown in FIG. 6, the invention is not so limited, and embodiments of the well bore seal element (7) can provide one, a pair, three, or a plurality of seal elements (19) whether providing a substantially triangular element (20) a raised portion (21) or other seal element configuration, or combinations or permutations thereof. The constructional forms of the sleeve (16) shown in FIG. 7 or similar constructional forms can be produced by various production methods such as fabrication, molding, or the like. One embodiment of the well bore seal element (7) can be molded using a variety of polyurethane, or other polymer compositions, which provide sufficient flexibility, compression, resiliency, and hardness for use as above-described.

Again referring primarily to FIG. 6, removal of the well bore seal element (7) can be accomplished in reverse order to redress or replace the well bore seal element (7). Redressing of the well bore seal element (7) to provide various thicknesses of the well bore seal element (7) can address various different inner diameter (ID) dimensions of the well bore (1) (or well bore casing (34)). The constructional form of the well bore seal element (7) depicted in FIG. 6 provides an embodiment having a plurality of seal elements (19) which project outwardly at an angular relation to the sleeve (16) such that upon location in a well bore (1) an upward movement of the body (6) of the apparatus (2) in the well bore (1) increases frictional resistance of the engaged surfaces of the well bore seal element (7) and the well bore (1) to be remove the well bore sleeve element (7) from body (6) of the apparatus (2). A new well bore seal element (7) may then be installed onto body (6).

Figure 7:
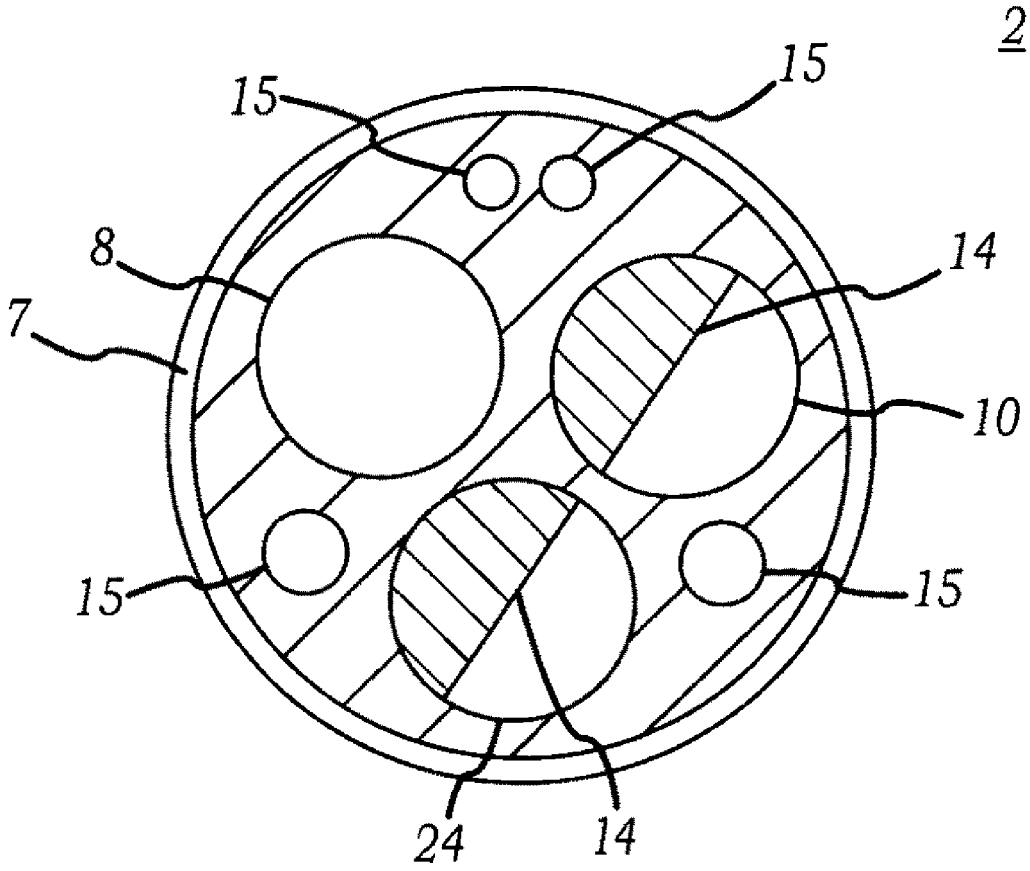
FIG. 7 is a cross-section view of the particular embodiment of the well bore fluid redistribution apparatus.
Figure 8:
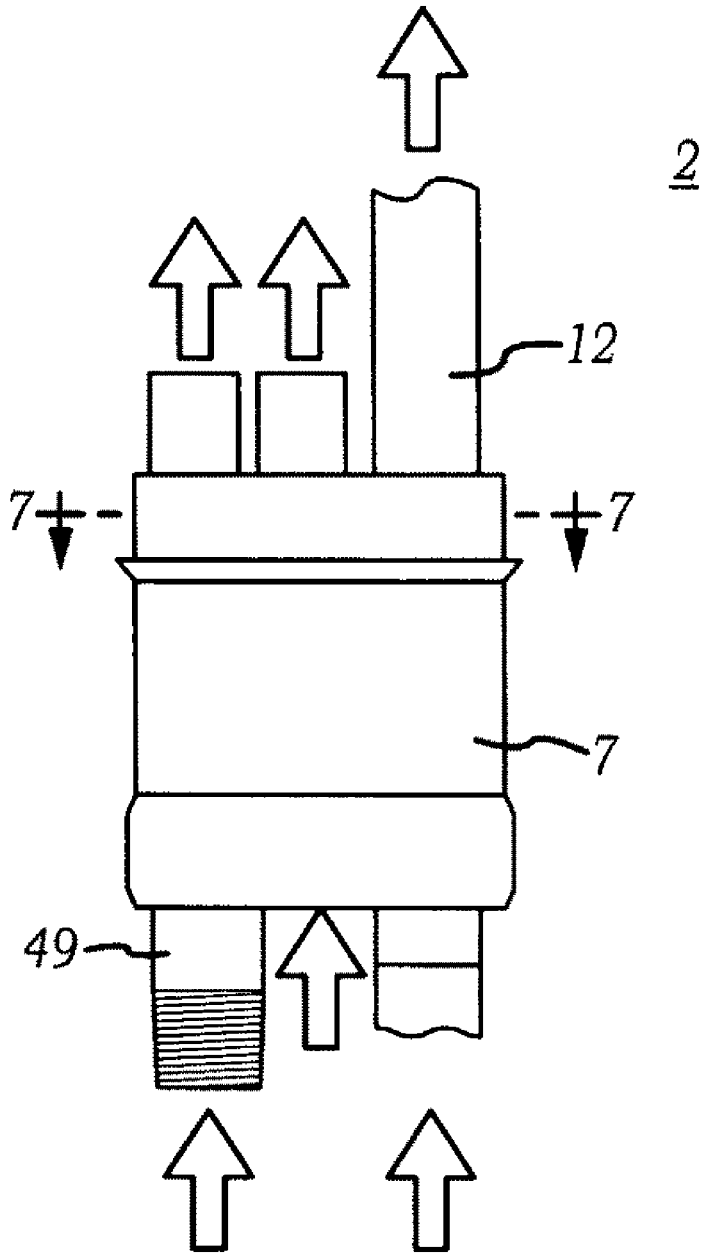
FIG. 8 is a front view of an embodiment of a well bore fluid redistribution apparatus.

Now referring primarily to FIGS. 7 and 8, certain embodiments of the well bore fluid redistribution apparatus (2) can further include a third port (24) (which can be one, two or a plurality of third ports depending upon the embodiment of the invention) which allows use of two or more of the well bore fluid redistribution apparatus (2) in a well bore (2). The third port (24) in certain embodiments can be coupled to a pump (9) to transfer bypass fluid (11) to a well outlet (13). One or more flow control elements (14), as above described, may be used to control fluid communication through the third port (24).

Now referring primarily to FIGS. 1, 2, 7, 8, 9, and 10, certain embodiments of the well bore fluid redistribution apparatus (2) can further provide a second apparatus (25) having a first port (8), a second port (10) and a third port (24) as shown in FIGS. 7 and 8 which can be coupled to the first apparatus (26) having a first port (8) and a second port (10) as shown in FIGS. 1 and 2. Now referring specifically to FIG. 9, the second apparatus (25) and the first apparatus (26) can be coupled in fixed relation such that the first apparatus (26) and the second apparatus (25) can be coaxially slide in the well bore (1) to locate each of the first apparatus (26) and the second apparatus (25) at a location in the well bore (1) which allows isolation of an amount of fluid (3) above and below each of the first apparatus (26) and the second apparatus (25).

The first port (8) of the first apparatus (26) can provide fluid communication through the body (6) of the first apparatus (26). A pump (9) can be provided in fluid communication with the first port (8) of the first apparatus (26) if the hydrostatic pressure of the fluid is insufficient to transfer the fluid through the first port (8). In the embodiment shown in FIG. 9, the pump (9) engages an amount of fluid (3) (the fluid for example being a liquid such as water) isolated below the first apparatus (26) (in a first portion (50) of the well bore (1)) produced by a first geologic section (4). Operation of pump (9) (or hydrostatic pressure of the liquid) in fluid communication with the first port (8) of the first apparatus (26) redistributes the fluid (3) in the first portion (50) of the well bore (1) below the first apparatus (26) to a second portion (51) of the well bore (2) above the second apparatus (26) or to a second geologic section (5) in fluid communication with the second portion (51) of the well bore (1) located above the first apparatus (26).

The second port (10) of the first apparatus (26) can also provide fluid communication through the body (6) of the first apparatus (26). A reduced pressure can be applied to the second port (10) of the first apparatus (25) to transfer an amount of fluid (3) (the fluid for example being a gas (36)) isolated in the first portion (50) of the well bore (1) below the first apparatus (26) produced by the first geologic section (4) to the second portion (51) of the well bore (1) above the second apparatus (26).

In the example provided by FIG. 9, the first geologic section (4) may be a first coal zone (or a plurality of coal zones) in fluid communication with the first portion (50) of the well bore (1) below the first apparatus (26) and the second geologic section (5) can be second coal zone (or a plurality of coal zones) in fluid communication with the second portion (51) of the well bore (1) above the first apparatus (26). The first geologic section (4) (the first coal zone) located below the depth of first apparatus (26) can produce water and a mixture of gases (36) (such as coal zone gases). Operation of the pump (9) in fluid communication with the first apparatus (26) can redistribute the water in the first portion (50) of the well bore (1) below the first apparatus (26) to a second portion (51) of the well bore (1) above the first apparatus (26). In some embodiments, the pump (9) can provide active production of the fluid (3) from the first geologic section (4) (the first coal zone) in fluid communication with the first portion (50) of the well bore (1(below the first apparatus (26), not relying upon hydrostatic pressure alone. This manner of generating active production of a fluid (3) from a first geologic section (4) or the active transfer of the fluid (3) to a portion of the well bore (1) above the second apparatus (26) (or to a second geologic section (5)) may be considered a controlled step or feature in regard to certain embodiments of the invention.

The bypass conduit (12) can be coupled to the second port (10) of the first apparatus (26). Operation of a vacuum pump (27) which can be part of a compressor (28) (such as a gas compressor for the recovery of methane gas or mixtures of gases from well bores) can sufficiently reduce pressure in the bypass conduit (12) to transfer the coal zone gases isolated in the well bore (1) below the second apparatus (26) through the second port (10) to the bypass conduit (12) for transfer to the surface (29) or the compressor (28) or both.

Figure 9:
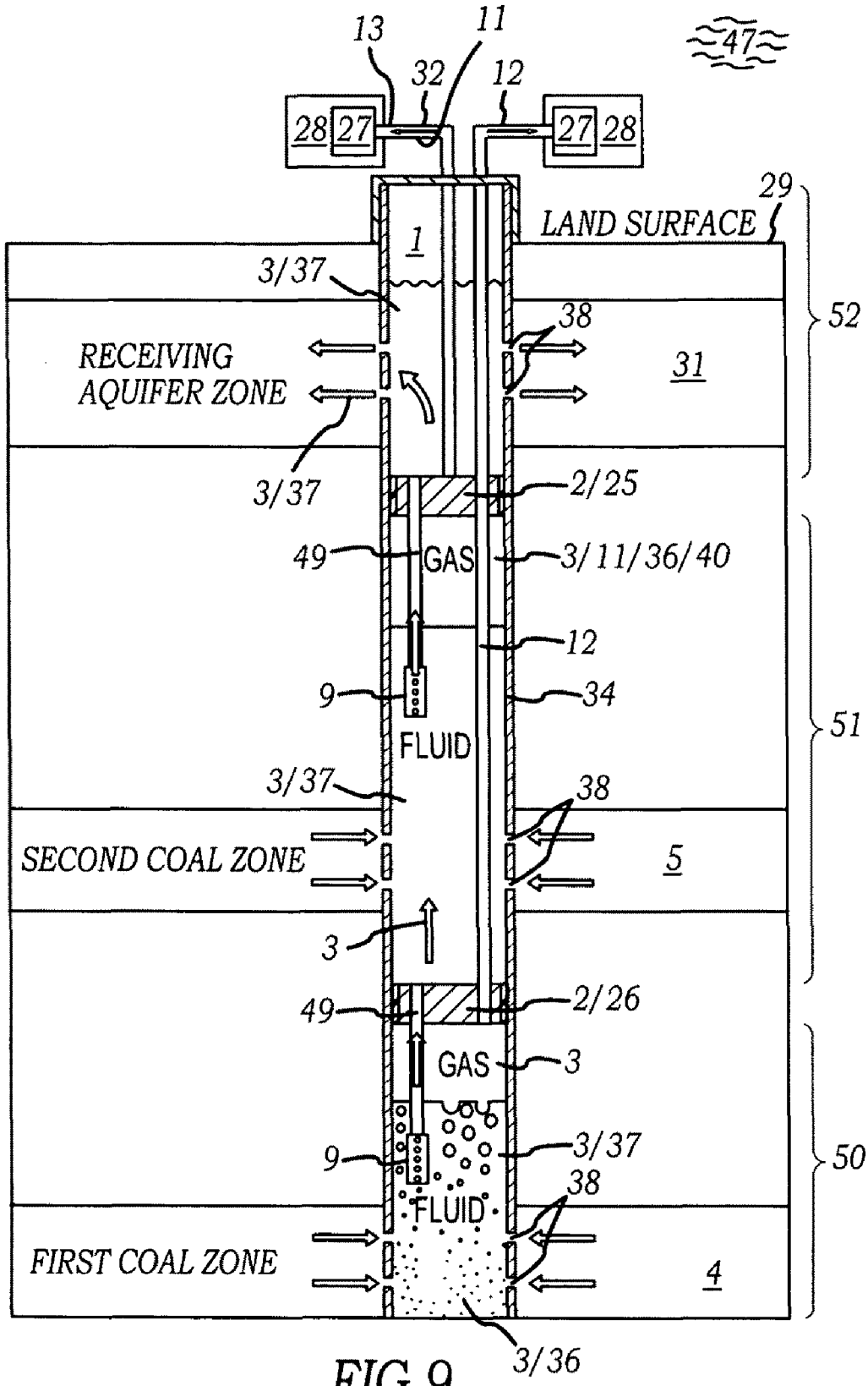
FIG. 9 is a cross-section view a particular embodiment of the invention which locates a first well bore fluid redistribution apparatus at a determined depth in a well bore and locates a second well bore fluid redistribution apparatus at determined depth in the well bore.
Figure 10:
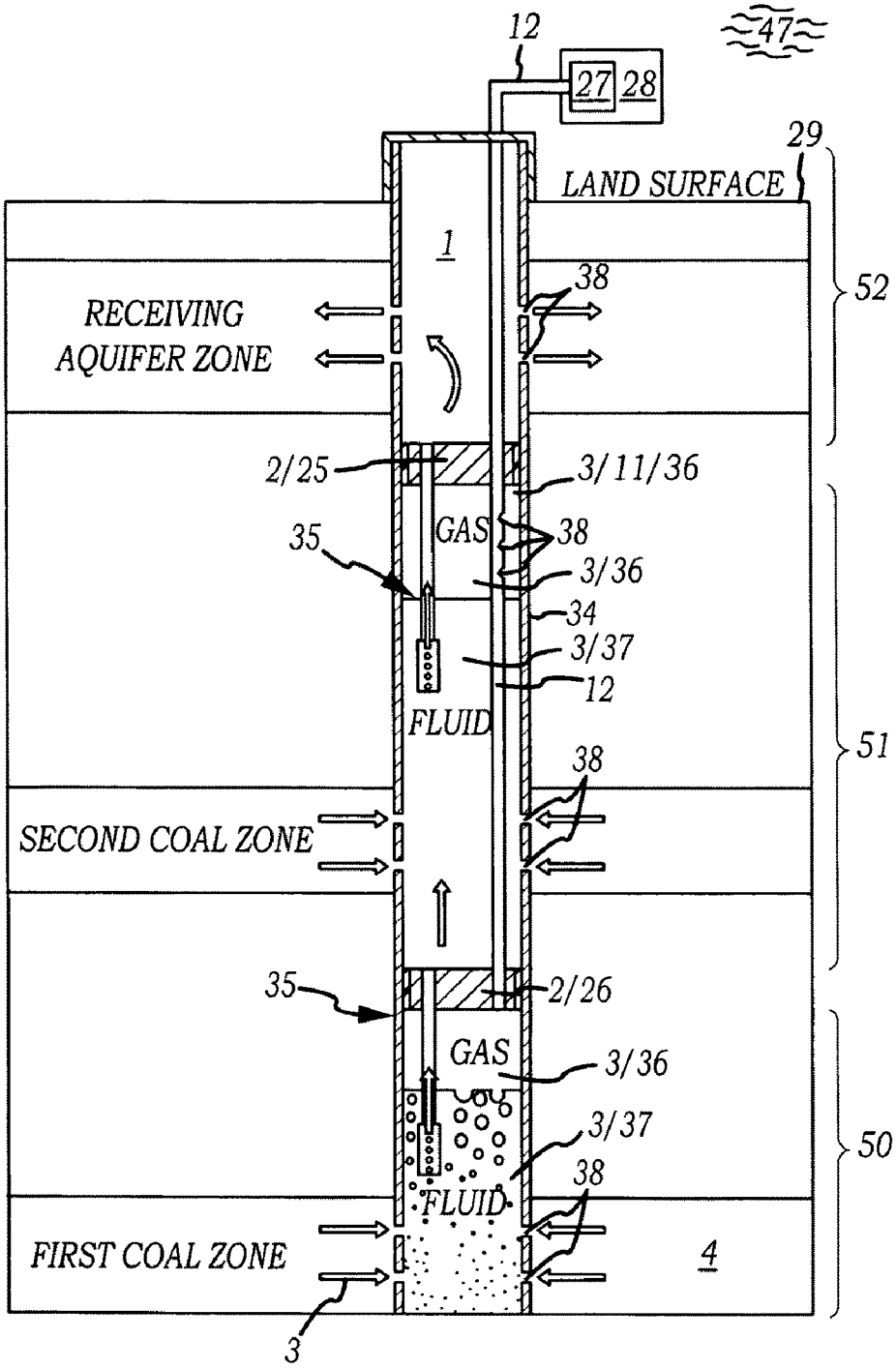
FIG. 10 is a cross-section view another particular embodiment of the invention which locates a first well bore fluid redistribution apparatus at a determined depth in a well bore and locates a second well bore fluid redistribution apparatus at determined depth in the well bore.

Again referring primarily to FIGS. 1, 2, 7, 8, 9, 10 a particular embodiment of the invention can further include a second apparatus (25) located a distance above the first apparatus (26) in the well bore (2). The second apparatus (25) can have a location which isolates the second geologic section (5) (shown as a second coal zone) in fluid communication with the second portion (50) of the well bore (1) below the second apparatus (25) and above the first apparatus (26) from a third geologic section (31) (shown in FIG. 9 as an aquifer zone) in fluid communication with a third portion (52) of the well bore (1) above the second apparatus (25). As to embodiments of the invention illustrated by the example of FIG. 9, the second apparatus (25) can be configured as shown in FIGS. 7 and 8, to provide a third port (24). As to embodiments of the invention as illustrated by the example of FIG. 10, the second apparatus (25/30) can be configured as shown in FIGS. 1 and 2.

With respect to the example of FIG. 9, the second apparatus (25) can be maintained in fixed relation to the first apparatus (26) by connection of a part of the bypass conduit (12) between the second port (10) of the first apparatus (26) and the second port (10) of the second apparatus (25), although other manners of maintaining the first apparatus (26) and the second apparatus (25) in fixed relation can be achieved by a connecting a member between the body (6) of the first apparatus (26) and the body (6) of the second apparatus (25) unconnected to any port(s). The part of the bypass conduit (12) connected between the second ports (12) of the first apparatus (26) and the second apparatus (25) can connected by mated spiral threads of the bypass conduit (12) and the second ports (10) (see for example FIG. 8) or other manner of connection such as welding, compression fit, ball and socket, or the like, which achieve sufficient engagement to maintain the first apparatus (26) in fixed relation to the second apparatus (25). The other part of the bypass conduit (12) can be connected to the outlet side of the second port (12) of the second apparatus (25) to transfer the fluid (3) in the form of coal zone gases isolated in the first portion (50) below the first apparatus (26) to the surface (29) or to a vacuum pump (27) which can be a part of a compressor (28).

Again referring primarily to FIG. 9, the fluid (3) produced by the second geologic section (5) (the second coal zone) in fluid communication with the second portion (51) of the well bore (1) above the first apparatus (26) and below the second apparatus (25) can be water, a mixture of gases, or both. A third port (24) of the second apparatus (25) which communicates through the body (6) of the second apparatus (25) allows transfer of fluid (3) in the form of the mixture of gases (36) isolated below the second apparatus (25) to the third portion (52) of the well bore (2) above the second apparatus (250. A second bypass conduit (32) can be coupled to the third port (24) (by mated spiral threads or otherwise). A second bypass conduit (32) can conduct the fluid (3) in the form of a gas (33) or mixture of gases isolated in the second portion (52) of well bore (2) below the second apparatus (25) and above the first apparatus (26) to the surface (29) or to a vacuum pump (27) which may be part of a compressor (28) (or a plurality of vacuum pumps or compressors).

The first port (8) of the second apparatus (25) can be fluidicly coupled to a pump (9) which engages the fluid (3) (in the form of a liquid or water) produced by the second geologic section (5) in fluid communication with the second portion (51) of the well bore (1) or transferred by the first apparatus (26) to the second portion (51) of the well bore (1), as above-described. Operation of the pump (9) can transfer the fluid (3) (in the form of water or other liquid) isolated in the second portion (51) of the well bore (1) below the second apparatus (25) through the first port (8) of the second apparatus (25) to the third portion (52) of the well bore (1) above the second apparatus (25) which can be redistributed to a third geologic section (31) whether actively by pumping or by hydrostatic pressure.

Now referring to the example of FIG. 10, the first apparatus (26) can be configured with a first port (8) and a second port (10) as shown in FIGS. 1 and 2. A plurality of bypass conduit apertures (33) can be located in the part of the bypass conduit (12) below the second apparatus (25) to allow transfer of the fluid (3) in the form of a mixture of gases (36) from the portion of the well bore (1) below the second apparatus (25) and above the first apparatus (26) through the second port (10) of the second apparatus (25) and through the bypass conduit (12) to the surface (29) or to the vacuum pump (27) which can be part of the compressor (28).

The first apparatus (26) and the second apparatus (25) of examples of FIGS. 9 and 10 can further include utility port(s) (15) to provide a passage through the body (6) of the second apparatus (25) for passage of power cables, sensors, transducers, or the like, to power the pumps, sense fluid levels, control operation of pumps, or the like.

Embodiments of the invention having configurations as shown by FIG. 10 can avoid the use of the third port (24) in the first apparatus (25). The examples of FIGS. 3, 4, 9 and 10 which show particular embodiments of the invention are not intended to be limiting. Rather these embodiments are intended to be illustrative of the broad range of embodiments of the invention which can be practiced by combination of the various elements described in various permutations by one of ordinary skill in the art.

As to certain embodiments, the well bore fluid redistribution apparatus (2) (25) (26) (or other embodiments of the well bore redistribution apparatus) may be engaged to a well bore casement (34) lining the well bore (1) at a gas separation depth (35), such as shown in any one of the examples of FIG. 3, 4, 9 or 10. The gas separation depth (35) may be the depth that allows for gas separation in the well bore (1) at the static water level. For example, the gas separation depth (35) may be a depth no greater than about 150 feet. A plurality of well, casement apertures (38) can be made in the well bore casement (34) at the depth of the first geologic section (4), the second geologic section (5), or the third geologic section (31) as shown for example in FIGS. 3, 4, 9, and 10. The geologic sections (4) (5) (31) or other geologic sections may have been identified through sample collection during drilling of the well bore (1) or interpreted from available well or borehole logs. Fluid (3) in the form of a liquid (37) (such as water or oil) or gas (36) (such as coal bed gases) produced by a first geologic section (4) may flow through the plurality of apertures (38) in the well bore casement (34) by gravity or due to pressure created by the action of the pump (9). The fluid (3) redistributed from the first geologic section (4) can pass through a similar plurality of apertures (38) in the well bore casement (34) to the second geologic section (5) or a third geologic section (31) depending upon the embodiment of the invention. Gas (36) liberated from the liquid (37) may then flow through the second port (10) of the apparatus (2).

Deeper geological sections (4) (5) (31) may contain fluid (3) (such as water, oil, gas) under pressure and therefore may not readily accept redistributed fluid (3) unless forced under great pressure. The well bore fluid redistribution apparatus (2) can be configured to redistribute the fluid to a geologic section which can readily accept redistributed fluid (3) in accordance with any of the various embodiments of the invention such as a shallow unconfined aquifer may have available storage capacity due in part to agricultural and other development uses that may remove water. Shallow geologic sections having permeability or porosity that may accept water can be identified from wells that have been drilled, possibly with well or borehole logs, sample cuttings or core. In some embodiments of the invention, the plurality of apertures (38) may be made adjacent to such geologic sections and not to other geologic sections which cannot receive redistributed fluid (3).

Now referring primarily to FIGS. 3, 4, 9 and 10, the pump (9) can operate to drive liquid (37) from a first geologic section (4) to a space in the well bore (2) above the apparatus (2) and below the well head (39). The liquid (37) may be forced through the plurality of apertures (38) of the well bore casement (34) into the second geologic section (5). Gas (36) produced by the first geologic section (4) can be bypassed through what may be a water-filled space between the apparatus and the well head (39) through the bypass conduit (12). An estimate of the amount of liquid (37) to be pumped may be used for example to calculate the sizes, numbers, and interval spacing of the plurality of apertures (38) necessary or desired to redistribute the fluid (3) in accordance with any particular embodiment of the invention.

Certain particular embodiments of the invention may be utilized in a well bore (1) drilled for purpose of producing an amount of coal bed gas (the composition of coal bed gas can vary with the supply but primarily consists of methane and ethane) from a coal bed geologic section. The coal bed geologic section may produce an amount of coal bed water and an amount of coal bed gas (a part of the coal bed gas may be contained in the amount of water). Coal bed gas produced by the coal bed geologic section may be diverted by the apparatus through the bypass conduit to the surface to a compressor or a gas separator while the amount of coal bed water can be redistributed from the coal bed geologic section to an aquifer geologic section or another coal bed geologic section, in accordance with any of the embodiments of the invention.

Naturally, certain embodiments of the invention can be utilized only to redistribute a liquid (37) such as water from a first geologic section (4) to a second geologic section (5) without the coincident redistribution of a gas (36) from the first geologic section (4) to the second geologic section (5).

Similarly, certain embodiments of the invention can be utilized only to redistribute a gas (36) such as coal bed gas (40) from a first geologic section (4) to a second geologic section (5) without the coincident redistribution of an amount liquid (37) from the first geologic section (4) to the second geologic section (5).

Figure 11:
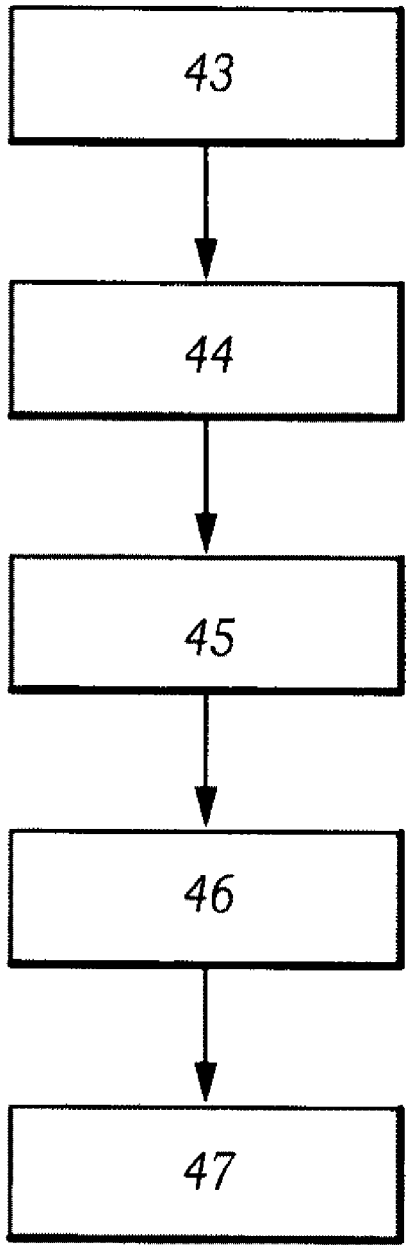
FIG. 11 is a block diagram which shows a particular method of the invention for distributing an amount of fluid between a first geologic section and a second geologic section.

Now referring primarily to FIG. 11, certain embodiments of the invention can include steps including: determining the depth of a first geologic section (4) (shown as block (43), determining depth of a second geologic section (5) (shown as block (44)), isolating the first geologic section from the second geologic section (shown as block 45), distributing an amount of fluid from the first geologic section (4) to the second geologic section (5) (shown as block 46).

In determining the depth of a first geologic section (43) or in determining depth of a second geologic section (44), any of a numerous and wide variety of assessment methods may be utilized separately or in various combinations or permutations such as sample collection during drilling of the well bore (1) or interpreted from available well or borehole logs other than the well bore (1), or geologic section maps, remote sensing images, geochemical surveys, or the like.

In isolating the first geologic section from the second geologic section (shown as block 45), any embodiment of the well bore fluid redistribution apparatus (2) or other similar or equivalent apparatus can be located at a depth in the well bore (1) between the first geologic section (4) and the second geologic section (5) with sufficient engagement of the external surface of the well bore fluid redistribution apparatus (2) (or similar or equivalent apparatus) to isolate the fluid (3) produced by either the first geologic section (4) or the second geologic section (5) (or both) above or below (or both) the well bore fluid redistribution apparatus (2).

In distributing an amount of fluid from the first geologic section (4) to the second geologic section (5) (46), the apparatus (2) can operate to transfer the isolated fluid (3) (whether a liquid or a gas) produced by the first geologic section (4) to the second geologic section (5). The first geologic section (4) can be located above or below the apparatus (2) and similarly the second geologic section (5) can be located above or below the apparatus (2) but as to those embodiments of the invention which include the step of isolating the first geologic section from the second geologic section (shown as block 45) the first geologic section (4) and the second geologic section (5) are typically located on opposite sides of the apparatus (2) (or similar or equivalent device).

Certain embodiments of the invention can further include the step of discharging fluid (3) to the surface (29) (shown as block 47). In discharging fluid to the surface (47) the fluid (3) can be a liquid (37) or a gas (36) whether isolated above or below the apparatus (2). As to those embodiments of the invention which include the step of distributing an amount of fluid from the first geologic section (4) to the second geologic section (5) (shown as block 46), typically, but not as to every embodiment, the liquid (37) can be redistributed from a first geologic section (4) to a second geologic section (5) while the gas (36) will be discharged to the surface (29). The term "discharging" includes discharge of the gas (or liquid) to the surface (29) or the atmosphere (48) or to a vacuum pump (27) or a compressor (28) or other facility for receiving and an amount of gas (36) or an amount of liquid (37).

As can be easily understood from the foregoing, the basic concepts of the present invention may be embodied in a variety of ways. It involves both redistribution techniques as well as devices to accomplish the redistribution. In this application, the distribution, redistribution, injecting, compliance, and other techniques of the present invention are disclosed as part of the results shown to be achieved by and the function of the various devices described and even as steps that are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these embodiments are encompassed by this disclosure.

Each feature, step, or element of the present invention can be representative of a broader function or of a great variety of alternative or equivalent features, steps, or elements. Each such broad function, alternative, or equivalent are included in this disclosure. Where the invention is described in device-oriented terminology, each element of the device implicitly performs a function; and if the invention is described as a function, each step of the method or process implicitly corresponds to an element, device, apparatus or assembly.

Any reference listed to be incorporated by reference in this application is hereby appended and hereby incorporated by reference; however, as to each of the above, to the extent that such information or statements incorporated by reference might be considered inconsistent with the patenting of the present invention, such as contradicting defined features or features ascertained by a reading of these patent documents, such information and statements are expressly not to be considered incorporated by reference. Furthermore, as to any dictionary definition or other extrinsic evidence utilized to construe this disclosure, if more than one definition is consistent with the use of the words in the intrinsic record, the claim terms should be construed to encompass all such consistent meanings.

Disclosure should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

We claim:

1. A well bore fluid redistribution assembly, comprising:

a) a first well bore fluid redistribution apparatus configured to engage a part of a well bore to fluidicly isolate a first portion of said well bore below said first well bore fluid redistribution apparatus and fluidicly isolate a second portion of said well bore above said first well bore fluid redistribution apparatus;

b) a first port of said first well bore fluid redistribution apparatus which provides fluid communication between said first portion of said well bore below said first well bore fluid redistribution apparatus and said second portion of said well bore above said first well bore fluid redistribution apparatus;

c) a second well bore fluid redistribution apparatus configured to engage a portion of said well bore at a location a distance above said first well bore fluid redistribution apparatus to fluidicly isolate a third portion of said well bore above said second well bore fluid redistribution apparatus and fluidicly isolate said second portion of said well bore below said second well bore fluid redistribution apparatus and above said first well bore fluid redistribution apparatus; and d) a first port of said second well bore fluid redistribution apparatus which provides fluid communication between said third portion of said well bore above said second well bore fluid redistribution apparatus and said second portion of said well bore below said second well bore fluid redistribution apparatus and above said first well bore fluid redistribution apparatus.

2. A well bore fluid redistribution assembly as described in claim 1, wherein a first geologic section has fluid communication with said first portion of said well bore below said first well bore fluid redistribution apparatus, and wherein a second geologic section has fluid communication with said second portion of said well bore above said first well bore fluid redistribution apparatus.

3. A well bore fluid redistribution assembly as described in claim 2, wherein said first geologic section produces an amount of fluid received by said first portion of said well bore below said first well bore fluid redistribution apparatus, wherein said amount of fluid produced by said first geologic section comprises an amount of liquid.

4. A well bore redistribution assembly as described in claim 3, further comprising a pump fluidicly coupled to said first port of said first well bore fluid redistribution apparatus which transfers said amount of liquid from said first portion of said well bore below said first well bore fluid redistribution apparatus to said second portion of said well bore above said first well bore fluid redistribution apparatus.

5. A well bore fluid redistribution assembly as described in claim 4, further comprising a second port of said first well bore fluid redistribution apparatus which provides fluid communication between said first portion of said well bore below said first well bore fluid redistribution apparatus and said second portion of said well bore above said first well bore fluid redistribution apparatus.

6. A well bore fluid redistribution assembly as described in claim 5, wherein said first geologic section produces an amount of fluid received by said first portion of said well bore below said first well bore fluid redistribution apparatus, wherein said amount of fluid produced by said first geologic section comprises an amount of gas.

7. A well bore fluid redistribution assembly as described in claim 6, further comprising a pump fluidicly coupled to said second port of said first well bore redistribution apparatus which operates to transfer said amount of gas from said first portion of said well bore below said first well bore fluid redistribution apparatus to said second portion of said well bore above said first well bore fluid redistribution apparatus.

8. A well bore fluid redistribution assembly as described in claim 7, further comprising a bypass conduit coupled between said second port of said first well bore redistribution apparatus and said pump to transfer said amount of gas from said first portion of said well bore below said first well bore fluid redistribution apparatus to a well outlet.

9. A well bore fluid redistribution assembly as described in claim 1, wherein said second geologic section produces an amount of fluid received by said second portion of said well bore above said first well bore fluid redistribution apparatus, wherein said amount of fluid produced by said second geologic section comprises an amount of liquid.

10. A well bore fluid redistribution assembly as described in claim 9, further comprising a pump fluidicly coupled to said first port of said first well bore fluid redistribution apparatus which transfers said amount of liquid from said second portion of said well bore above said first well bore fluid redistribution apparatus to said first portion of said well bore below said first well bore fluid redistribution apparatus.

11. A well bore fluid redistribution assembly as described in claim 1, wherein said third geologic section has fluid communication with said third portion of said well bore above said second well bore fluid redistribution apparatus and said second geologic section has communication with said second portion of said well bore below said second well bore fluid redistribution apparatus and above said first well bore fluid redistribution apparatus.

12. A well bore fluid redistribution assembly as described in claim 11, wherein said second geologic section having communication with said second portion of said well bore below said second well bore fluid redistribution apparatus and above said first well bore fluid redistribution apparatus produces an amount of fluid, wherein said amount of fluid produced by said second geologic section comprises an amount of liquid.

13. A well bore fluid redistribution assembly as described in claim 12, further comprising a pump fluidicly coupled to said first port of said second well bore fluid redistribution apparatus which transfers said amount of liquid from said second portion of said well bore below said second well bore fluid redistribution apparatus and above said first well bore fluid redistribution apparatus to said third portion of said well bore above said second well bore fluid redistribution apparatus.

14. A well bore fluid redistribution assembly as described in claim 13, further comprising a second port of said second well bore redistribution apparatus which provides fluid communication between said second portion of said well bore below said second well bore fluid redistribution apparatus and said third portion of said well bore above said second well bore fluid redistribution apparatus.

15. A well bore redistribution assembly as described in claim 14, wherein said bypass conduit couples between said second port of said first well bore fluid redistribution apparatus said second port of said second well bore fluid redistribution apparatus.

16. A well bore fluid redistribution assembly as described in claim 15, wherein said bypass conduit further couples between said second port of said second well bore fluid redistribution apparatus and said pump which operates to transfer said amount of gas from said first portion of said well bore below said first well bore fluid redistribution apparatus to said well outlet.

17. A well bore fluid redistribution assembly as described in claim 16, wherein said bypass conduit coupled between said second port of said first well bore fluid redistribution apparatus said second port of said second well bore fluid redistribution apparatus further comprises a plurality of apertures which allow fluid communication between said second portion of said well bore and the hollow interior of said bypass conduit.

18. A well bore fluid redistribution assembly as described in claim 17, wherein said plurality of apertures have a location which allows transfer of an amount of gas from said second portion of said well bore to said hollow interior of said bypass conduit.

19. A well bore fluid redistribution assembly as described in claim 18, further comprising a third port which provides fluid communication through said second well bore fluid redistribution apparatus between said second portion of said well bore below said second well bore fluid redistribution apparatus and said third portion of said well bore above said second well bore fluid redistribution apparatus.

20. A well bore fluid redistribution assembly as described in claim 19, further comprising a second bypass conduit coupled to said third port which allows an amount of fluid to transfer from said second portion of said well bore to said well outlet, wherein said amount of fluid comprises an amount of gas.

21. A well bore fluid redistribution assembly as described in any one of claim 8, 16, 18, 19, or 20, wherein said amount of gas is selected from the group consisting of: an amount of gas produced by a geologic section, an amount of gas produce by a coal zone, an amount of coal bed gas, an amount of coal bed methane gas, an amount of petroleum gas, an amount of a mixture of gases, and an amount of methane gas.

22. A well bore fluid redistribution assembly as described in any one of claim 3, 9 or 12, wherein said amount of liquid is selected from the group consisting of: an amount of liquid produced by a geologic section, an amount of liquid produce by a coal zone, an amount of coal bed liquid, an amount of a mixture of liquids, an amount of oil, and an amount of water.

* * * * *